United States Patent [19]

Okada

[11] Patent Number: 4,657,256

[45] Date of Patent: Apr. 14, 1987

[54] SLOT MACHINE WITH WIN/LOSS BIASING MEANS

[75] Inventor: Kazuo Okada, Tokyo, Japan

[73] Assignee: Kabushiki Kaisha Universal, Tochigi, Japan

[21] Appl. No.: 856,843

[22] Filed: Apr. 25, 1986

Related U.S. Application Data

[63] Continuation of Ser. No. 671,447, Nov. 14, 1984, abandoned.

[30] Foreign Application Priority Data

Nov. 14, 1983 [JP] Japan ..... 58-212547

[51] Int. Cl.[4] ..... A63F 7/00

[52] U.S. Cl. ..... 273/143 R; 273/138 A

[58] Field of Search ..... 273/138 A, 143 R; 364/411, 412, 717

[56] References Cited

U.S. PATENT DOCUMENTS

| | | | |
|---|---|---|---|
| 3,852,576 | 12/1974 | Rudd | 273/138 A |
| 4,213,524 | 7/1980 | Miyashita et al. | 273/138 A |
| 4,240,635 | 12/1980 | Brown | 273/138 A |
| 4,448,419 | 5/1984 | Telnaes | 273/143 R |
| 4,494,197 | 1/1985 | Troy et al. | 273/138 A |

FOREIGN PATENT DOCUMENTS

| | | | |
|---|---|---|---|
| 2103856 | 2/1983 | United Kingdom | 273/143 R |

*Primary Examiner*—Richard C. Pinkham
*Assistant Examiner*—MaryAnn Stoll Lastova
*Attorney, Agent, or Firm*—Young & Thompson

[57] ABSTRACT

A slot machine has a game number counter which cumulatively counts the number of games played. Whether the number of games counted by the game number counter reaches a predetermined number or not is detected by a comparator; and if both numbers coincide, a coincidence signal is output from the comparator. The slot machine has also a winning number counter which cumulatively counts the number of wins occurring during the period until the number of games reaches the predetermined number. At the time the coincidence signal is obtained, the number of wins cumulatively counted by the winning number counter is compared with a standard number of winnings. As a result of this comparison, if the number of wins in the winning number counter is larger than the standard number of wins, the following game is set to decrease the likelihood of a win; but in the contrary case, the same control is actuated for shifting a winning combination of symbols onto a winning line.

4 Claims, 2 Drawing Figures

SLOT MACHINE WITH WIN/LOSS BIASING MEANS

This application is a continuation of application Ser. No. 671,447, filed Nov. 14, 1984, now abandoned.

BACKGROUND OF THE INVENTION

The present invention relates to a slot machine, and more particularly to a slot machine in which winning is so controlled as to occur with a predetermined probability and in which the number of wins to occur is averaged for any given number of games.

In a slot machine, generally a plurality of juxtaposed reels rotating at high speed are sequentially and automatically stopped, or alternatively each of the reels is independently stopped by manipulation of a stop button for each reel. At the time the reels stop, a win decision is made in accordance with the combination of symbols stopped and positioned on a winning line, and coins (including tokens) are paid out in the number that the kind of win indicates.

In such a slot machine, the number of all of the possible combinations of symbols is determined by the number and kind of symbols disposed on respective ones of the reels. Among all of the possible combinations, the number of winning symbol combinations determines the probability of getting a win.

Although the overall win probability is so established, it is natural that the probability of getting a win during a given game is governed by temporal chance while repetitively playing game. Thus, despite the overall win probability, the actual win is generated utterly by chance. This means that there is a substantial possibility for the probability of getting a win in any particular game to vary with time. Therefore, if a large number of wins occur during a certain limited number of games, it is known statistically that the probability of getting a win is decreased during the subsequent interval. As a result, a player playing the game during such a subsequent interval may lose interest in the game because of the reduced chance to get a win.

OBJECT OF THE INVENTION

It is a principal object of the present invention to provide a slot machine which can hold the player's interest in the game during any time period.

It is another object of the present invention to provide a slot machine which can control the symbols positioned upon a winning line in such a manner that the number of wins can be averaged every time a predetermined number of games is played.

It is a further object of the present invention to provide a slot machine which can shift the symbol on a winning line by detecting electronically with a microcomputer the combination of plural symbols to be stopped on the winning line, such that getting a win becomes easier or harder.

SUMMARY OF THE INVENTION

In order to achieve the above objects, the present invention comprises storing means for cumulatively storing under the control of a microcomputer the number of played games and the number of wins that have occurred. The cumulative number of wins during a preset number of played games is compared with the predetermined standard number of wins, and control means is actuated in response to the compared output to control the symbol positioned on the winning line, and so the occurrence of wins is made adjustable. The control means may be the one disclosed in U.S. Pat. No. 4,573,681.

The present invention may be applied not only to a slot machine using a reel having symbols disposed on its periphery, but also to a slot machine of the type that the game is played with a plurality of symbol characters displayed on a CRT.

BRIEF DESCRIPTION OF THE DRAWINGS

Other objects and advantages of the present invention will become apparent from the following discussion of the accompanying drawings, wherein.

DETAILED DESCRIPTION OF THE INVENTION

Figure 1:
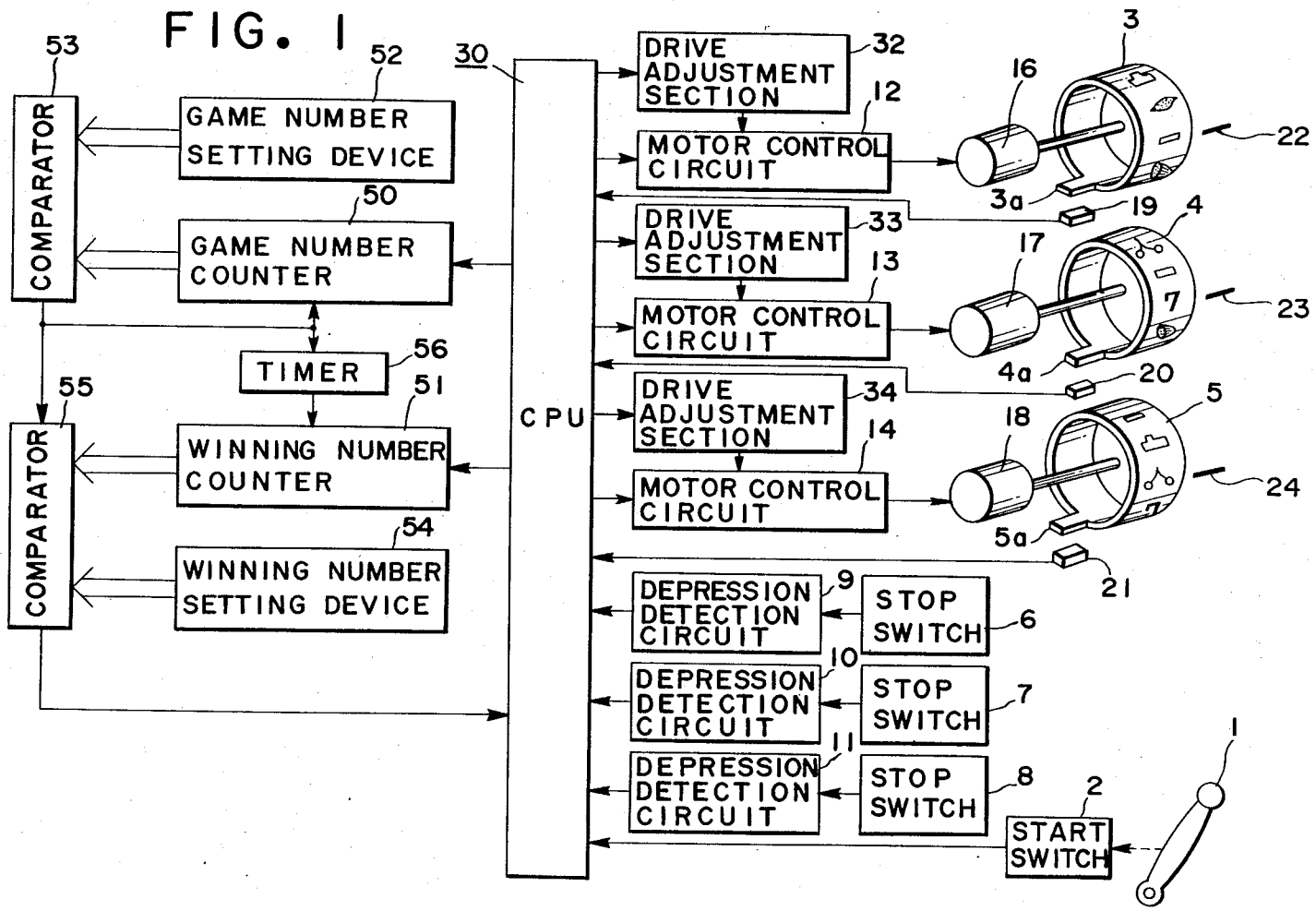
FIG. 1 is a block diagram showing the construction and arrangement of a slot machine according to the present invention.

Referring to FIG. 1, by pulling an operation handle 1 mounted at the side of a slot machine, a start switch is turned on and a CPU (Central Processing Unit) 30 is prepared to start a game. Thereafter a game program begins, and in turn motor control circuits 12 through 14 are each supplied with a train of pulses. Then, stepping motors 16 through 18 rotate and drive corresponding reels 3 through 5.

The number of drive pulses supplied to the motor control circuits 12 through 14 are counted by the CPU 30, the counted values being indicative of the rotated positions of the reels 3 through 5. Light-intercepting lugs 3*a* through 5*a* are formed on the reels 3 through 5, and each rotation of the reels 3 through 5 is detected with photo-interrupters 19 through 21. When the photo-interrupters 19 through 21 detect the light intercepting lugs 3*a* through 5*a*, the count value of drive pulses having been counted under control of the CPU 30 is cleared zero. Therefore, the identity of the symbols passing below winning lines 22 through 24 and set for respective reels 3 through 5, can be related with one-to-one correspondence to the count value of the drive pulses supplied to the respective reels 3 through 5.

After each reel 3 through 5 attains a constant rotation speed, upon depression of the stop switches 6 through 8, stop signals are input through respective depression detection circuits 9 through 11 to the CPU 30. In this case, the drive pulses to the motor control circuits 12 through 14 corresponding to the respective stop switches 6 through 8 are terminated so that stepping motors 16 through 18 stop. Instead of the stop switches 6 through 8, random timers for automatically stopping each reel 3 through 5 may be provided.

At the time each reel 3 to 5 stops, the symbol stopping on the corresponding winning line 22 through 24 is identified based on the counted number of drive pulses supplied to each reel 3 to 5. The combination of symbols on the winning lines 22 through 24 is judged by the CPU 30 as to whether it corresponds to a winning combination or not. If the combination is a winner, then a hopper device (not shown) is actuated to pay out a number of coins corresponding in number to the kind of win.

The slot machine to which the present invention is applied further comprises a game number counter 50 and a winning number counter 51. The game number counter 50 receives a count up signal from the CPU 30 every time a game is played, and the number of played games is cumulatively stored. The winning number counter 51 receives a count up signal from the CPU 30 when it is decided that a win has occurred during any one of the played games, and the number of such wins is cumulatively stored. The cumulatively counted value of the game number counter 50, together with the constant number of games stored in a game number setting device 52 are input to a comparator 53. The comparator 53 renders operative a comparator 55 when both of the input values to the former coincide. The comparator 55 compares whether the number of wins counted by the winning number counter 51 is larger or smaller than the stored value of the winning number setting device 54 in which the standard number of wins is stored. Then, a comparison output corresponding to the compared results is input to the CPU 30. The CPU 30 executes the following processing in accordance with the comparison effected by the comparator 55:

(1) Winning counter>Standard winning number—>Set a game losing flag (2) Winning counter=Standard winning number—>Set nothing (3) Winning counter<Standard winning number—>Set a game winning flag Upon reception of a coincidence signal from the comparator 53, the counted value of the game number counter 50 is reset to "0", and also the counted value of the winning number counter 51 is reset to "0".

Following the above and at the start of the next game, the CPU 30 checks the setting states of the winning flag and the game losing flag at the end of the preceding game. In the case in which the winning flag is set, drive adjustment pulses are supplied through drive adjustment sections 32 through 34 to the motor control circuits 12 through 14 so as to drive the stepping motors 16 through 18 to the positions where a winning combination occurs.

The above operation is carried out when, without the help of the above operation, the reels 3 through 5 would stop at any of the positions losing a game due to poor timing of the manipulation of the stop buttons 6 through 8. Since the rotated positions of the stepping motors 16 through 18 can be detected from the number of drive pulses, the number of drive adjustment pulses for stopping the stepping motors 16 through 18 at positions where a winning combination occurs can be previously calculated. Similarly, if the game losing flag is set, the above mentioned drive adjustment pulses are supplied so that the stepping motors 16 through 18 are driven in rotation to positions losing the game, if without such drive adjustment pulses the stepping motors 16 through 18 would have stopped at winning positions.

Figure 2:
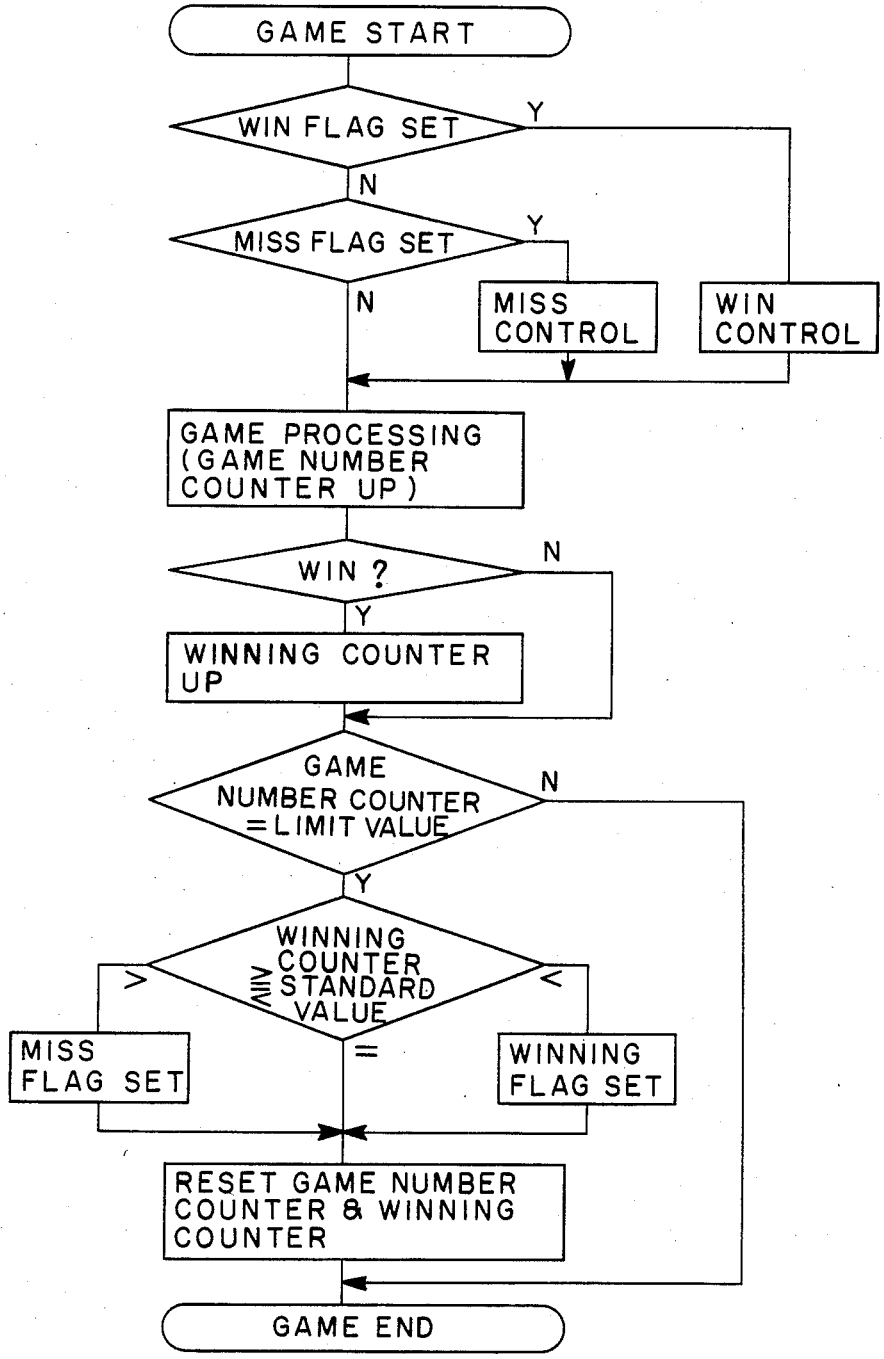
FIG. 2 is a sequence diagram showing the processing by the arrangement shown in FIG. 1.

FIG. 2 is a sequence diagram showing the above described processing. By executing the above processing, games are repeated while detecting, at intervals equal to the number of games preset in the game number setting device 52, whether the number of wins awarded during each such interval is appropriate or not.

It is to be noted that in a winning flag setting state, too large a shift of reel position causes the player to become aware of it, so it is preferable to shift by only one or two symbols on the reel. Therefore, if a win is not reached with such amount of shift, the winning flag setting state is retained until such processing in compliance with the winning flag is executed and the flag is reset.

It is known that in an ordinary slot machine, a large number of codes for winning exists, due to the various kinds of win. In this case, the constituent elements 50 through 56 shown in FIG. 1 may be such as to have as many numbers as the number of the winning codes. Further in this case, the decisions shown in FIG. 2 are repeated as many times as the number of winning codes. It is also possible to simplify the construction by grouping several kinds of wins into a single block and using a single counter, instead of using each winning code for each processing.

Instead of the game number counter 50 used in the above embodiment, a coin number counter for cumulatively storing the number of coins inserted during every game may be used, and the counted value of the number of coins obtained from the counter may be used as a game number. With such modification, in a slot machine of the type in which three symbols appear through a slot machine display window for each reel, a plurality of winning lines, such as three lines horizontal and also two oblique lines, can be set, and the number of winning lines increases in correspondence with the number of coins inserted for a game. If the number of coins inserted is plural in number, it is judged that the same number of games is executed. Therefore, the limit value stored in the game number setting device 52 can be used effectively also in this modified embodiment. In this case, it is quite certain that the win decision is carried out for every one of the winning lines, and that when a plurality of wins is generated, the corresponding number of count up signals is delivered.

Furthermore, the present invention may equally be applied to a credit-type slot machine in which prior to the start of a game, a number of coins is inserted and the display of the number of coins inserted is changed in accordance with the results of the game.

Having described the present invention in relation to the embodiment shown in the accompanying drawings, it is intended that the invention not be limited by any of the details of this description, unless otherwise specified, but rather be construed broadly within its spirit and scope as set out in the accompanying claims.

What is claimed is:

1. In a slot machine of the type in which the presence or absence of a win is determined for each game based upon the combination of symbols disposed on a winning line, the improvement comprising:

means for cumulatively storing the number of games played;

means for cumulatively storing the number of wins every time a game is played and a win occurs;

first comparison means for comparing said cumulatively stored number of games played to a pre-set number of games;

second comparison means, rendered operative by said first comparison means, for comparing said stored number of wins with a predetermined standard number of wins every time said first comparison means determines that the stored number of games equals said pre-set number of games; and control means for altering the stopping positions of said symbols on said winning line in such a manner that when said comparison means detects that said stored number of wins is larger than said standard number of wins, said combination of symbols is biased away from a winning combination, and when said comparison means detects that said stored number of wins is smaller than said standard number of wins, said combination of symbols is biased toward a winning combination;

reset means for resetting to zero said game number storing means and said win number storing means each time said second comparison means compares said cumulatively stored number of wins with said predetermined standard number of wins.

2. An apparatus according to claim 1, wherein said symbols are disposed on the peripheries of a plurality of reels driven in rotation by stepping motors.

3. An apparatus according to claim 2, wherein said control means controls the stopping of said stepping motors.

4. An apparatus according to claim 3, wherein said control means adjusts the number of drive pulses supplied to said stepping motors.

* * * * *